United States Patent [19]

Highberg

[11] 4,010,583

[45] Mar. 8, 1977

[54] FIXED-SUPER-ABRASIVE TOOL AND METHOD OF MANUFACTURE THEREOF

[75] Inventor: Carle W. Highberg, Sylvania, Ohio

[73] Assignee: Engelhard Minerals & Chemicals Corporation, Murray Hill, N.J.

[22] Filed: Apr. 17, 1975

[21] Appl. No.: 569,303

Related U.S. Application Data

[63] Continuation-in-part of Ser. No. 473,915, May 28, 1974, abandoned.

[52] U.S. Cl. ..... 51/284; 51/206.5; 51/209 R; 51/297; 51/309 R; 51/325; 51/356

[51] Int. Cl.[2] ..... B24B 13/02; B24D 3/10; B24D 7/10

[58] Field of Search ..... 51/206.5, 209 R, 209 DL, 51/283, 284, 296, 309, 356, 397, DIG. 34, 325

[56] References Cited

UNITED STATES PATENTS

| | | | |
|---|---|---|---|
| 779,848 | 1/1905 | Hart | 51/206.5 |
| 1,672,574 | 6/1928 | Maynard | 51/209 DL |
| 2,226,506 | 12/1940 | van der Pyl | 51/209 R |
| 3,128,580 | 4/1964 | Davis | 51/209 R X |
| 3,146,561 | 9/1964 | Lindblad | 51/206.4 |
| 3,181,193 | 5/1965 | Nobles et al. | 15/114 |
| 3,203,775 | 8/1965 | Cantrell | 51/296 X |
| 3,510,990 | 5/1970 | Steindler | 51/356 X |
| 3,594,963 | 7/1971 | Beasley | 51/356 X |
| 3,756,796 | 9/1973 | Miller | 51/206 R |
| 3,795,497 | 3/1974 | Weiss | 51/297 |
| 3,883,996 | 5/1975 | Waller | 51/206 R |

OTHER PUBLICATIONS

Sarofeen "High Speed Removal and Fine Finishes in Glass" Proceedings of IDA Industrial Diamond Revolution Technical Conference, 1967, pp. 233–241.

*Primary Examiner*—Al Lawrence Smith
*Assistant Examiner*—K. J. Ramsey

[57] ABSTRACT

This improved fixed-super-abrasive tool for grinding and polishing toric and other curvilinear lenses is produced by a novel method of manufacture and comprises a substantially-rigid, super-abrasive-free backing member and a malleable preformed super-abrasive wafer conformed and releasably secured thereto. The substantially-rigid, super-abrasive-free backing member has a curved support surface determinative of the curvature of the curvilinear working surface. The substantially-malleable preformed abrasive wafer has a predetermined thickness and one surface which, in the method of the present invention, is conformed to the curved support surface, either before or at the time of securing. The wafer comprises super-abrasive particles having a Knoop Hardness in excess of about 3000 kg/mm² in a malleability-imparting powdered metal matrix, which facilitates the conformation step. A porous surface may be created by introduction of particles which are dissolved during use of the tool, leaving pores which assist the grinding and polishing processes.

3 Claims, 18 Drawing Figures

FIXED-SUPER-ABRASIVE TOOL AND METHOD OF MANUFACTURE THEREOF

CROSS-REFERENCE TO RELATED APPLICATIONS

This application is a continuation-in-part of Ser. No. 473,915, filed May 28, 1974, now abandoned.

BACKGROUND OF THE INVENTION

1. Field of the Invention

This invention relates to super-abrasive tools for grinding and polishing the curved surface of optical and ophthalmic lenses, including toric surfaces, and to a novel method of manufacturing the tool. More specifically, it relates to a novel super-abrasive grinding and polishing tool and method of making the same which increases production, reduces costs and produces an improved product.

While the present invention will be described with particular reference to several embodiments of the novel tool and method of manufacturing the same, particularly as to its application as a toric generator, it should be understood that the invention is not limited thereto. The concepts set forth herein can be readily adapted for use in connection with other grinding, polishing and lapping operations and the like, as those skilled in the art will recognize in the light of the present disclosure.

As used herein, the term "super-abrasive" refers to abrasive media suitable for grinding and polishing conventional ophthalmic and optical lens glass and having a hardness on the Knoop scale in excess of about 3000 kg/mm$^2$. A comparison of Knoop and Mohs hardness values for conversion purposes is available in standard handbooks. Conventional super-abrasives include natural and synthetic industrial diamonds and cubic boron nitride, although the present invention is not necessarily limited thereto.

2. Description of the Prior Art

As those skilled in the art appreciate, many optical and ophthalmic lenses have one curvature on one axis but a different curvature on the axis at right angles thereto, e.g., a toric lens. In a typical prior-art grinding operation, such toric surfaces are generated by a three-step process, i.e., a rough grinding step, a fine grinding step and a polishing step.

In the first or rough grinding step the glass blanks are ground to the general shape of the desired finished product, e.g., a ellipsoid configuration as a first approximation, using diamond-impregnated peripheral or ring-type grinding wheels of conventional design. In the second or fine grinding step a hard metal tool having the desired toric surface is reciprocated across the roughly-ground concave or convex ellipsoid lens surface in one direction to provide the desired curvature in that direction and then at right angles thereto to get the other curvature. In this step the grinding action is provided by means of a liquid slurry containing loose common abrasive particles in finely-divided form, e.g., garnet, silicon carbide, emery, alumina or the like, which slurry is continuously poured over the reciprocating tool and lens blank as the operation proceeds. In the third or polishing step a polishing pad is applied to a hard metal tool and the reciprocating action is repeated. The polishing action is provided by a liquid slurry containing loose abrasives having the desired polishing characteristics, e.g., zirconium oxide, cerium oxide or the like.

The second or fine grinding step is critical, as those skilled in the art recognize. For example, any substantial improvement therein, particularly from a quality standpoint, has the compounded benefit of simplifying and decreasing the cost of the subsequent polishing step. It is to this critical second step that the present invention is primarily directed. The third or polishing step also has been improved by extension of certain concepts of the invention to a novel polishing pad.

It would be particularly advantageous in the second step to use a fixed-super-abrasive concave or convex grinding medium having the desired toric configuration to grind the desired surface, rather than a loose abrasive slurry. This would speed up the operation, reduce its cost, and has the potential of improving quality. It would otherwise avoid the many disadvantages of handling a loose abrasive slurry. It would also minimize an annoying slurry disposal problem, particularly from an ecological standpoint. It would also avoid the substantial cost of having to periodically replace, refinish, or otherwise restore the curvature to, the hard metal tool which is simultaneously subjected to the abrasiveness of the slurry.

A hard metal tool, e.g., steel, can, of course, be readily shaped to the desired toric configuration using, for example, a single surface tool such as a pointed diamond impregnated tool. It was heretofore impractical, however, to attempt to generate a large-area, diamond-impregnated, toric-configured surface because of the rapid wear in a single surface tool due to the presence of the diamond particles. Use of diamond impregnated tools for fine grinding has been possible for producing spherical lenses, which have only a single curvature and can be ground by a tool simply rotating about a single axis perpendicular to the lens surface. The inherently more complex toric lenses required more complex movements of both tool and lens and prevented introduction of the diamond impregnated tools. Accordingly, much of the industry has continued with the time-consuming, costly and cumbersome loose abrasive approach.

One prior-art approach to coping with certain of the problems associated with the loose-slurry grinding and polishing techniques is to apply protective pads to the hard metal tools having the desired toric configuration. The pad experiences most of the undesired wear from the abrasive slurry; and the protective pad is periodically replaced before substantial wear of the toric surface of the hard metal tool occurs. Such approach is represented, for example, in a number of prior-art patents.

Beasley U.S. Pat. No. 3,594,963, for example, discloses the use of a replaceable grinding pad for a lens grinding tool. The pad may comprise a stamped sheet steel blank having a thickness between 0.005 and 0.010 inch, which is adhered to the grinding tool by means of a suitable contact cement of adequate bonding strength.

Faas U.S. Pat. No. 3,144,737 and Sarofeen U.S. Pat. No. 3,522,680 similarly discloses grinding pads or overlays which conform to the shape of the tool and protect it from the grinding action of the abrasive slurry. But such approaches, while advantageous, represent only a partial solution to what is otherwise a high-cost, slow, cumbersome method of manufacture.

The aforementioned problems are further compounded by the very large number of spherics and toric encountered in conventional grinding and polishing operations. This is reflected in high inventory requirements and/or extended delays in filling orders.

OBJECTS OF THE INVENTION

It is therefore a general object of the present invention to cope with the aforementioned prior-art problems. It is another general object to provide an improved apparatus for grinding, polishing and lapping optical and ophthalmic lenses and a novel method of manufacturing the improved apparatus. It is another general object to provide an improved tool which permits the grinding of lens blanks to a curvilinear configuration, including toric surfaces, using fixed super-abrasives. It is another general object to provide an improved apparatus for grinding and polishing glass which may be used in already-existing grinding and polishing machines of conventional design and results in higher production rates, lower costs, and/or an improved product.

It is another general object to provide an economic method of producing super-abrasive tools for the grinding and polishing of optical and ophthalmic lenses. It is another general object to provide super-abrasive grinding and polishing tools wherein the grinding and polishing surfaces, when worn, may be readily and inexpensively replaced with reduced turn-around time. It is another general object to provide a super-abrasive grinding and polishing tool which reduces the requirement for slurries of loose abrasives when grinding and polishing glass lenses and thus minimizes the handling and disposal problems associated therewith.

It is a specific object to provide a method of manufacturing super-abrasive tools for the grinding and polishing of glass and the like which permits the super-abrasive component thereof to be held in inventory in a flat conformation but lends itself to the prompt manufacture of super-abrasive tools therefrom having any desired curvilinear surface, as determined by the curvature of the backing member.

It is another specific object to provide a super-abrasive tool wherein the super-abrasive component thereof may be substantially completely used in a grinding or polishing operation without risking undesired wear of, or modification to, the curvature of the reusuable, carefully-contoured backing member.

It is still another specific object to provide an improved method of manufacturing fixed-super-abrasive tools having substantial thicknesses for prolonged cycle time. It is another specific object to provide a method of manufacturing a super-abrasive tool wherein the super-abrasive component may be readily contoured to a desired configuration despite the presence of extremely-hard, non-malleable super-abrasive particles.

In a particular embodiment, it is another object to provide a grinding and polishing tool which permits higher grinding and polishing pressures so as to produce an improved product at higher speed and lower cost. It is another specific object to provide a grinding and polishing tool which avoids so-called "dead" areas on the lens surface being worked, which areas are "starved" because of a lack of sufficient coolant or lubricant. It is another specific object to provide a grinding and polishing tool wherein fluids, e.g., coolants and lubricants, can be introduced at the interface of the surface being worked and the tool surface, preferably at or adjacent the center for optimum cooling and lubricating action.

It is another specific object of the invention to improve the final polishing step subsequent to the fine grinding step by introducing a polishing pad which is matched with and compatible with the fine grinding and polishing tool.

These and other objects will become apparent to those skilled in the art as the detailed description proceeds.

SUMMARY OF THE INVENTION

These objects are achieved by the novel grinding and polishing fixed-super-abrasive tool and the method of manufacturing the same which make up the present invention. The grinding tool, which has a curvilinear working surface or predetermined conformation, comprises a substantially rigid, non-abrasive backing member, a substantially-malleable, preformed abrasive wafer conformed thereto, and means for releasably securing the wafer to the backing member.

The backing member has a curved support surface which is determinative of the curvature of the curvilinear working surface. The preformed abrasive wafer has a predetermined thickness in excess of about 1/32 inch for prolonged cycle time and tool life, typically 1/16 inch or more. One surface is in contact with and conformed to the curved support surface of the backing member whereby a predetermined desired conformation is imparted to the exposed surface of the abrasive water. While the curvature is determined by the shape of the toric lens surface to be created, the size and peripheral shape of the backing member and the abrasive wafer is determined by the area swept by the lens as it moves during the grinding operation. The abrasive tool moves generally with a different motion from that of the lens and the tool is made so that it matches and does not exceed the edge of the area swept by the lens.

The preformed abrasive wafer comprises super-abrasive particles dispersed substantially uniformly in a powdered metal matrix which binds the super-abrasive particles so as to form the wafer. As already indicated, the super-abrasive particles may be obtained from commercial sources, e.g., suppliers of natural or synthetic industrial diamonds or cubic boron nitride. In a preferred embodiment the preformed abrasive wafer is multilayered, typically twolayered, and includes a layer adjacent the backing member which is substantially free of super-abrasive particles. Grinding and polishing efficiency is improved in a preferred embodiment by introduction of particles into the matrix which dissolve in the cooling fluid used and thereby create a porous surface, which improves cooling of the lens surface and removal of swarf.

The means for releasably securing the contacting surface of the wafer to the backing member may include conventional means and techniques which provide the desired releasable bond which can stand the grinding and polishing forces without bond failure. The used and worn wafer, however, should be readily removable when replacement is desired. In a preferred embodiment, the bond is made by means of conventional electrical solder, although other adhesives may also be used, e.g., epoxy adhesives.

In still another preferred embodiment, the abrasive wafer has at least one aperture therethrough adjacent the center and one or more exposed channels radiating therefrom towards the periphery. The backing member also has a passageway therein in fluid communication with the aperture whereby fluids, such as a coolant, lubricant or the like, may be delivered through the passageway in the aperture to the exposed channels. This eliminates "dead" spots and areas and assures enhanced cooling and desired lubricity at the grinding or polishing interface and provides for the efficient removal of the swarf resulting from the grinding or polishing operation. In a preferred embodiment the channels are restricted to create a pressurized cooling system.

In a preferred embodiment of the method of manufacture, the dual-layer wafer is formed by subjecting a non-super-abrasive layer and a powdered metal matrix containing super-abrasive particles and coolant-soluble pore-creating particles to sintering conditions to form an integral structure. The resulting substantially-flat, dual-layer, malleable wafer is then disposed adjacent a backing member with the super-abrasive-free layer towards a curved support surface thereof. The adjacent surface is then conformed, e.g., by pressure, to the support surface whereby a predetermined desired conformation is readily imparted to the exposed surface of the wafer. The conformed wafer is then secured to the backing member, preferably by soldering the same thereto, and the resulting tool is used in a lens grinding operation with improved results. Alternatively, the wafer may be preconformed and stored in a particular shape to facilitate rebuilding of a worn tool. This simple method of manufacturing the tool makes the use of fixed abrasives for the grinding step economically feasible and more than competitive with the prior-art loose abrasive technique.

In a parallel aspect of the invention a polishing pad matching in size and shape the super-abrasive tool, but made of softer material and containing no super-abrasives, replaces the super-abrasive tool for the fine polishing of a ground lens, using conventional abrasive slurries.

BRIEF DESCRIPTION OF THE DRAWINGS

The present invention will be more clearly understood from the following detailed description of specific embodiments read in conjunction with the accompanying drawings, wherein.

It should be understood that the drawings are not necessarily to scale and that the embodiments may be illustrated by graphic symbols, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE DRAWINGS, INCLUDING PREFERRED EMBODIMENTS

Figure 1:
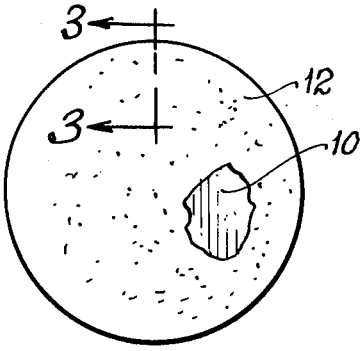
FIG. 1 is a cutaway view of the preferred two-layer embodiment of the integrally-formed, fixed-super-abrasive wafer of the present invention, as viewed from the abrasive side, prior to being conformed and releasably secured to a substantially circular backing member.
Figure 2:
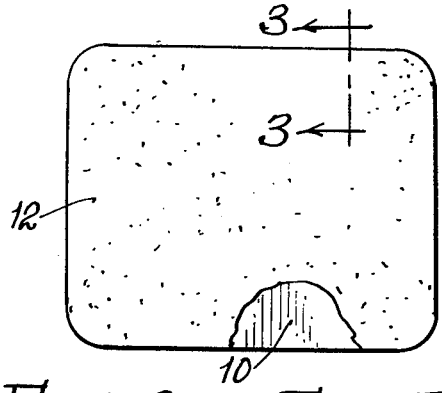
FIG. 2 is a cutaway view of another embodiment similar to FIG. 1 except that it is rectilinearly configured to conform to a similarly configured backing member.
Figure 3:
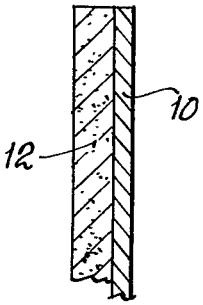
FIG. 3 is a magnified sectional view taken along the lines 3—3 of FIGS. 1 and 2.

Referring to FIGS. 1, 2 and 3, the preferred two-layer or dual-layer embodiment of the fixed-super-abrasive wafer includes a first layer 10 comprising a substantially non-abrasive malleable buffer medium and a second layer 12 comprising super-abrasive particles homogeneously distributed throughout and bonded by a powdered metal matrix. The two layers integrally formed in the sense that they are fused or otherwise blended at the interface to form an integral structure.

For long tool life, abrasive layer 12 has a thickness of at least about 1/32 inch, preferably in excess of 1/32 inch. Since non-abrasive buffer layer 10 is not normally subjected to wear, it typically does not exceed a thickness of 1/32 inch, although it may so exceed, if desired, for other reasons.

Since the wafer has a substantial predetermined thickness usually in excess of about 1/32 inch, e.g., about 1/16 inch, and must be conformed precisely to a curved backing member having a substantial curvature, e.g., a radius or radii of curvature of less than about 36 inches, both layers 10 and 12 must have substantial malleability despite the presence of the non-malleable super-abrasive materials. In preferred embodiments, layer 10 comprises a copper sheet of commercial purity, e.g., in excess of about 99% copper; and layer 12 comprises super-abrasive particles in a powdered metal matrix comprising about 85 to 98% by weight of copper and about 15 to 2% by weight of tin. Alternatively, both layers 10 and 12 may comprise a powdered metal bond, layer 12 also having the super-abrasive particles dispersed therein.

Commercial grade copper and tin powders having a suitable particle size distribution to form a firm bond for the abrasive particles may be employed. Preferred embodiments include copper and tin powders such as may be used as bonds for grinding wheels, e.g., Alcan Grade MD 201 or MD 301 copper powders typically having an average particle size of about 9 and 8 microns, respectively, and Alcan Grade MD 201 or MD 301 tin powders typically having an average particle size of about 12 microns. The invention is not, of course, limited to a copper-tin powdered metal bond, as those skilled in the art will recognize in the light of the present disclosure.

The super-abrasive may comprise any suitable grinding or polishing medium having sufficient hardness to efficiently and economically grind or polish the grades of glass normally employed for optical and ophthalmic lenses. As already indicated, a Knoop Hardness in excess of about 3000 kg/mm$^2$ is required. While this requirement eliminates common abrasives such as quartz, aluminum oxide and silicon carbide, it does permit the use of cubic boron nitride, as well as natural or syntehtic diamonds. In one commercial version sold by General Electric Company under the trademark BORAZON, cubic boron nitride has a hardness of about 4700 kg/mm$^2$. This compares with a hardness of roughly about 7000 kg/mm$^2$ for diamonds.

The size and concentration of the super-abrasive particles in the powdered metal bond depend in part upon the type of operation being carried out and the particular material being worked. Other factors, representing tradeoffs, include quality of surface, speed of grinding and related cost considerations. As those skilled in the art will recognize, the requirements for a rough grinding operation are different from those of a finish polishing or lapping operation. In preferred embodiments, diamond powders conforming to Bureau of Standards (C.S. 261/63) Grade Numbers 9, 15 or 30, which correspond to a size range of about 8 to 36 microns, may be employed.

The concentration of diamonds in the bond may range from about 2 to about 25% by volume of the total matrix. Thus, for example, a matrix may comprise about 10% by volume of super-abrasives and about 90% by volume of bond, the latter comprising about 95% by weight copper and about 5% by weight tin. Other bonding ingredients may also be added, as those skilled in powdered metallurgical arts will readily recognize.

In a preferred embodiment cooling and swarf removal during the grinding operation are achieved by introducing particles which are soluble in the cooling fluid used and thus create a porous surface in the matrix adjacent the super-abrasive particles. Table salt, having 80–120 mesh size particles and between 10–50% by volume, has been found particularly suitable for introducing porosity.

While in the embodiments depicted in these drawings, buffer layer 10 is an inexpensive commercial grade copper sheet, e.g., 1/32 inch thick copper sheet, it may also contain other compatible metals so long as the resulting alloy has the requisite malleability to permit exact and precise conformation to the backing member, as hereinafter described. While buffer layer 10 is normally free of super-abrasives, it may contain, if desired, low-cost common abrasives such as aluminum oxide, silicon carbide, and the like. Since its primary function is to act as a buffer between the super-abrasive layer and the backing member, however, the grinding or polishing operation should be terminated as soon as the super-abrasive layer is worn through.

If only a single layer is employed, this layer, which contains the super-abrasive, is soldered, cemented or otherwise releasably secured directly to the backing member. More than two layers may also be employed to produce special effects, e.g., an outer super-abrasive layer, an intermediate common abrasive layer, and an abrasive-free inner layer which is soldered or releasably cemented to the backing member.

While the super-abrasive wafers depicted in FIGS. 1–3 have a constant thickness, the invention is not necessarily limited thereto. The thickness may be varied, e.g., from the center to the outer edges, so as to achieve, when conformed to the curvature of the backing member, a desired configuration. Thus, backing members having the same configuration may be utilized to produce grinding tools having different curvatures at the grinding surface. In multilayer embodiments, the variations in wafer thickness may be achieved by varying all layers or less than all. Thus, for example, in the preferred dual-layer embodiment, the super-abrasive layer may have a constant thickness to achieve the desired curvature when conformed to the backing member. Other possible variations and modifications manifest themselves, as those skilled in the art will readily recognize.

Figure 4:
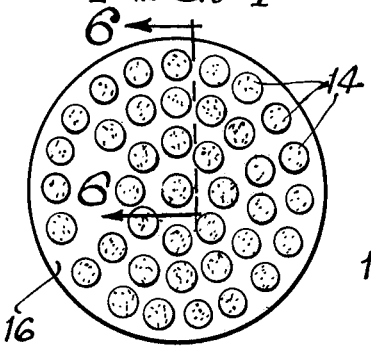
FIG. 4 is another embodiment of the fixed-super-abrasive wafer of the present invention, wherein fixed-super-abrasive studs are integrally secured to a circular, substantially malleable metal backing member.
Figure 6:
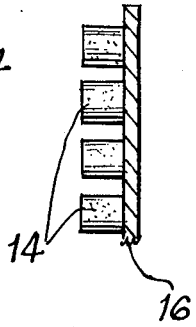
FIG. 6 is a magnified sectional view taken along the lines 6—6 of FIGS. 4 and 5.
Figure 5:
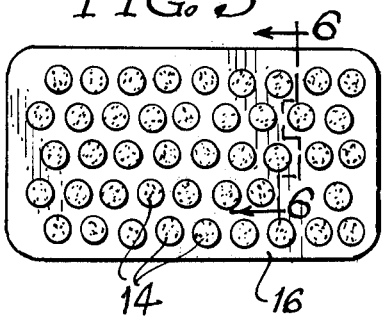
FIG. 5 is another embodiment similar to FIG. 4 except that the malleable metal backing member is rectilinearly configured to conform to a similarly configured backing member.

The embodiments of FIGS. 4–6 differ from those of FIGS. 1–3 in that the super-abrasive layers are discontinuous and comprise a plurality of studs or nodules 14 integrally formed on malleable support 16. These embodiments provide what might be termed a pelletized lap. While the studs are protrayed as right circular cylinders, they need not necessarily be. Oval-shaped, rectilinear-shaped and other configurations may also be employed, as desired.

The composition of the individual studs 14 may be substantially the same as super-abrasive layer 12. Introduction of porosity by addition of soluble particles into the matrix as heretofore described is effective in this embodiment as well. Since a plurality of spaced studs 14 integrally formed on support 16 are more readily conformed to a curvilinear backing member, the powdered metal bond for the super-abrasive need not be as malleable. Accordingly, when using a coper-tin bond, higher percentages of tin, which inhibits malleability, may be employed; and the combination would still have the requisite malleability. For example, in the embodiments of FIGS. 4 and 5, the amounts of tin in the copper-tin bond for the super-abrasive of the studs 14 may be as high as 25% by weight of bond, as contrasted to a maximum of about 15% by weight of bond in the embodiments of FIGS. 1–3.

Figure 7:
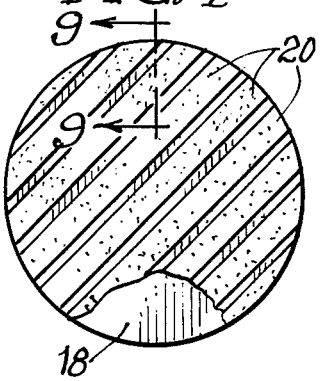
FIG. 7 is a cutaway view of still another embodiment similar to that of FIG. 1 except that the super-abrasive layer is segmented or indented to provide parallel channels between the super-abrasive segments.
Figure 9:
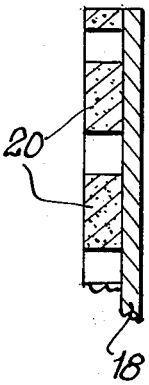
FIG. 9 is a magnified sectional view taken along the lines 9—9 of FIGS. 7 and 8.
Figure 8:
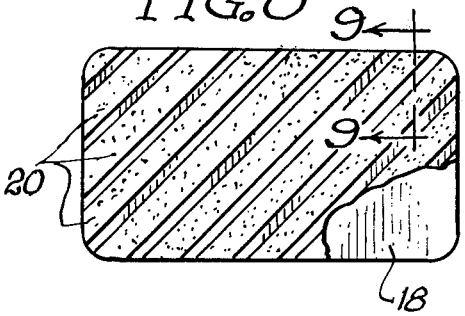
FIG. 8 is a cutaway view of another embodiment similar to FIG. 7 except that the wafer is rectilinearly configured to conform to a similarly configured backing member.

The super-abrasive wafer embodiments of FIGS. 7–9 comprise non-abrasive supporting layer 18 and a plurality of spaced bars or segments of super-abrasive material 20. The composition of the super-abrasive layer and the non-abrasive layer may be substantially that set forth in the embodiments of FIGS. 1–3 or FIGS. 41–6.

The channels or spaces between the segments of the super-abrasive material may be cut or molded therein, preferably the latter. The channels typically have a depth equal to the full thickness of the abrasive layer, thereby exposing the supporting layer 18. Alternatively, it may be less or greater. In the latter case, there is still some channel available for coolant and lubricant flow even when the abrasive layer is substantially worn. These channels permit the externally applied coolant to flow to the surface being ground. As in the embodiment of FIGS. 4–6, the flow of coolant or lubricant dissipates the heat, provides enhanced lubricity, and carries away grinding and polishing debris (swarf).

One of the advantages of the novel tool and method of manufacture thereof is that the super-abrasive wafer may be preformed flat and placed in inventory. When needed, it can be drawn from inventory and conformed to whatever the curvilinear working surface of the backing member may be. This substantially reduces costs and permits the rapid rehabilitation or worn grinding tools. The simplicity of this method of producing the fixed-super-abrasive tool having a predetermined curvature makes the fine grinding of complex curvatures, e.g., toric surfaces, using such fixed super-abrasives economically and technically feasible and competitive with loose abrasive grinding. Alternatively, the wafers may be preconformed and stored with a desired shape, thereby simplifying the rebuilding of worn tools. Despite the adaptation of the tool size and shape to the machine configuration uneven wear may still occur, making it necessary to resurface the super-abrasive surface periodically during its useful life. Eventually the tool will be sufficiently worn that its abrasive layer is substantially consumed and must be replaced by a new wafer from inventory.

Figure 10:
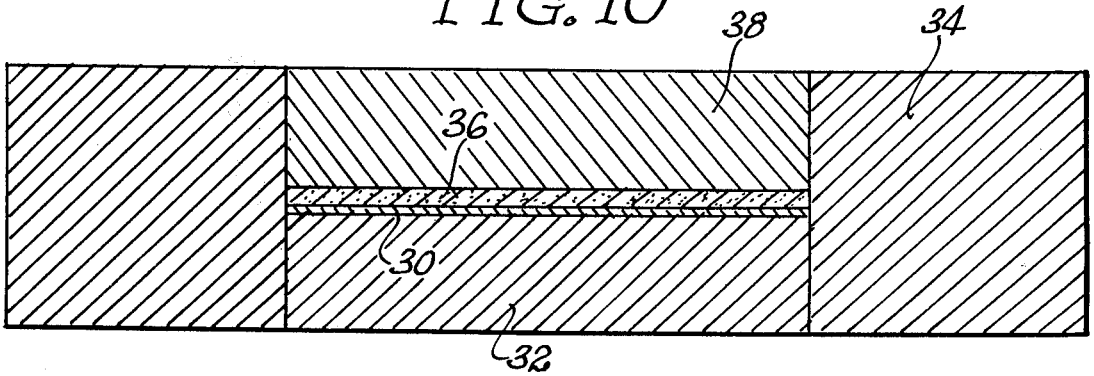
FIGS. 10 through 13 are diagrammatic sectional views illustrating successively certain of the steps in the method of manufacturing a preferred embodiment of the super-abrasive grinding tool of the present invention.

The first step in forming the flat abrasive wafer is best illustrated in FIG. 10. Copper sheet 30, typically having a thickness of about 1/32 inch, and a configuration corresponding to the circular outline of FIGS. 1, 4 or 7, or the rectilinear outline of FIGS. 2, 5 or 8, or any desired configuration, is disposed on under-support 32 within sintering mold 34. A homogeneous mixture of super-abrasive particles, and bonding particles, e.g., copper and tin, is then added as layer 36. Overlying pressure fixture or mold cover 38 is then added, and the mold subjected to sintering conditions.

Such conditions are well known to those skilled in the art and depend in part upon the powdered metals employed. In the examples set forth herein, they may include pressures in the range of about 500–1000 p.s.i. and temperatures in the range of about 500° C – 750° C. The proper selection of these conditions results in a bonding of the super-abrasive particles and an integrally-formed, two-layer hot-pressed wafer.

The embodiment of FIG. 10 would result in the continuous abrasive layer depicted in FIGS. 1 and 2. To achieve the studded configuration of FIGS. 4 and 5 or the spacedly-segmented configurations of FIGS. 7 and 8, or other desired configurations, an appropriate mold filler or templet, e.g., a plate having apertures therein corresponding to the studs, would be placed on top of the copper sheet 30 before the homogeneous mixture of abrasive particles and bonding medium would be added thereto, as those skilled in the art will recognize. Once formed, the wafer may be placed in inventory in its flat condition. The mold may be contoured to provide an initial curvature to the wafer. Although this may complicate the storage problems, it does simplify the rebuilding of worn tools by replacement of the super-abrasive wafer.

Figure 11:
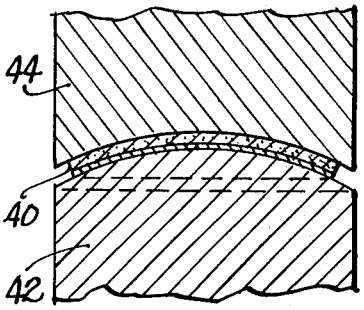

When it is desired to form the tool of the present invention from the wafer preformed as in FIG. 10, the wafer may initially be subjected to a preliminary contouring or bending step, as illustrated in FIG. 11. Thus, for example, the preformed abrasive wafer 40 is placed between upper and lower mandrels 42 and 44 of an appropriate press and subjected to sufficient pressure to provide an initial curvature to the wafer. The opposed convex and concave surfaces of mandrels 42 and 44, respectively, may, for example, have a semi-hemispherical or ellipsoidal curvature approximating the ultimate curvature desired. The precurvature of the wafer assures that in the subsequent conforming step it will more readily and ultimately conform exactly to the curvature of the backing member to which it will be releasably secured.

Figure 12:
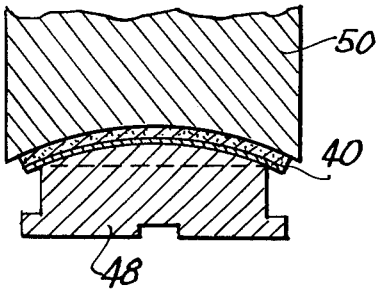
Figure 13:
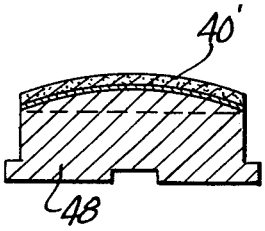

Referring to FIG. 12, wafer 40 is disposed between backing member 48 and a resilient or hydraulic-type opposed structure 50. Sufficient pressure is then exerted whereby wafer 40 exactly conforms to the curvature of the exposed surface of backing member 48 so as to produce the desired conformation on the outer abrasive surface of wafer 40. Any excess peripheral material may then be trimmed from wafer 40 so that the margins thereof conform exactly to the periphery of backing member 48, as illustrated by trimmed wafer 40′ in FIG. 13.

Backing member 48 may be of conventional design, that is, similar to the hard steel tools employed when using abrasive slurries as the abrasive source. As those skilled in the art will recognize, backing member 48 is configured so that it can be used in conventional grinding and polishing machines.

Trimmed wafer 40′ is releasably secured to backing member 48 by conventional techniques. In a preferred embodiment, a conventional silver solder, such as is employed for electrical soldering, may be employed for such purposes. Alternatively, the wafer may have been cemented to backing member 48 by an appropriate adhesive, e.g., an epoxy cement. The step of releasably securing the wafer to backing member 48 may be carried out simultaneously with the step of conforming the wafer to the backing member, as illustrated in FIG. 12. In any event, the securing means should be such that the worn wafer can be readily stripped from the backing member without damage thereto, whereby the backing member may be readily refurbished by affixing a new super-abrasive wafer thereto.

A principal advantage of having a two-layer abrasive pad arises from the fact that the super-abrasive layer can be used until a breakthrough to the super-abrasive-free layer occurs. There is no risk of damage or undesired modification to the curvature of the surface of the backing member. Thus, the backing member may be used over and over again by repeating the steps outlined above whereby a new wafer is added to the backing member as required. This reduces the cycle time and over-all cost and assuring that the same curvature will be repeatedly replicated. In addition, the non-abrasive layer provides a cushioning or shock-absorbing effect which increases tool life and decreases the possibility of shock or fatigue fracture of the super-abrasive layer or premature shock separation of the abrasive pad from the backing member.

As previously indicated, the backing member and associated super-abrasive wafer can be readily engineered to almost any desired configuration. The proper curvature is readily machined into the steel backing member; and the malleable fixed-super-abrasive wafer is then conformed thereto to impart the desired curvature to the wafer.

Figure 14:
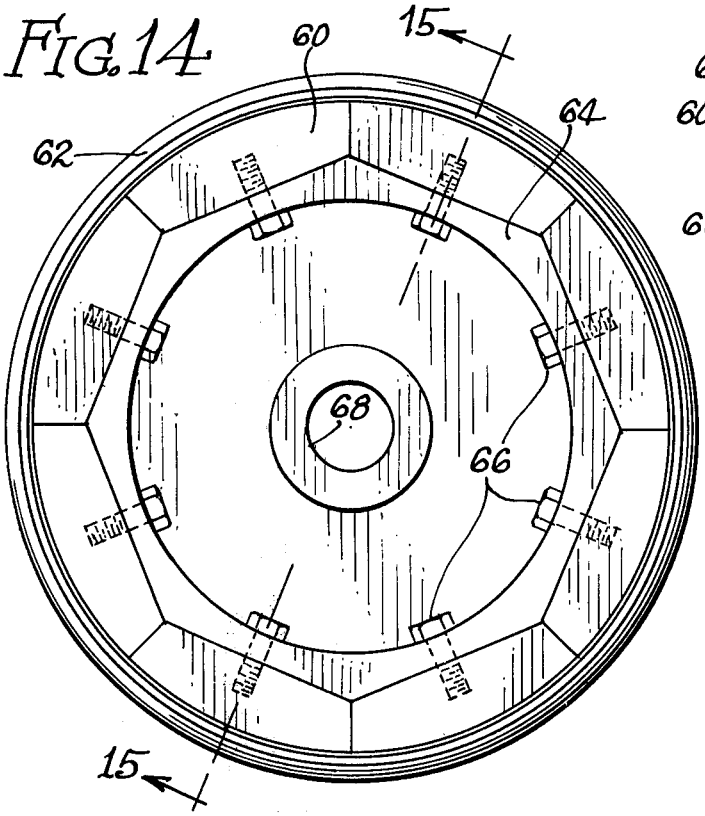
FIG. 14 is an elevation view illustrating a particular application wherein a plurality of fixed-super-abrasive tools of the present invention are assembled on a hub to form a toroidal grinding tool.

The method of the present invention may also be used to produce a plurality of individual tool segments which are assembled in alignment to form a continuous grinding or polishing surface. An exemplar of this is depicted in FIG. 14 wherein a plurality of individual tools are assembled on a hub to form a continuous toroidal grinding and polishing tool. Thus, backing members 60 and associated grinding pads 62 are assembled on the periphery of hub 64 by bolts 66. This provides a fixed-super-abrasive grinding or polishing tool have a toroidal configuration similar to those of the prior art which, unlike the present embodiment, require the addition of abrasive slurries to carry out the grinding or polishing operation. The hub is rotated by a suitable shaft inserted in aperture 68 of hub 64.

Figure 15:
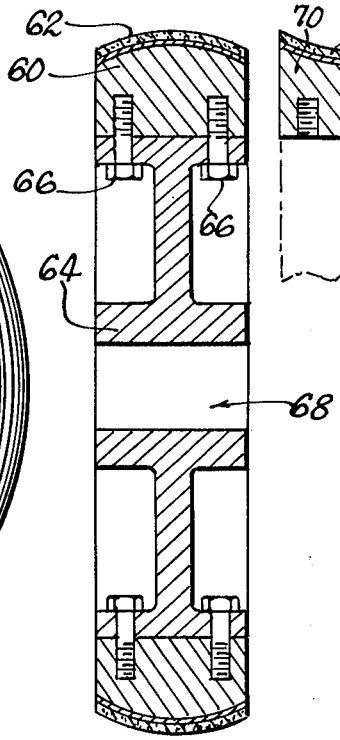
FIG. 15 is a sectional view taken along the lines 15—15 of FIG. 14.
Figure 16:
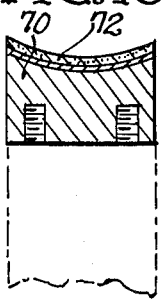
FIG. 16 is a sectional view of an embodiment similar to that of FIGS. 14 and 15 except that the grinding surface is concave rather than convex.

A concave toroidal tool may be similarly assembled, as illustrated in FIG. 16. Thus, backing member 70 has a concave outer surface to which the dual-layer, super-abrasive wafer 72 is conformed. A plurality of the resulting tools are aligned and bolted to the periphery of a hub, which may be the same or similar to hub 64 of FIGS. 14 and 15.

Figure 17:
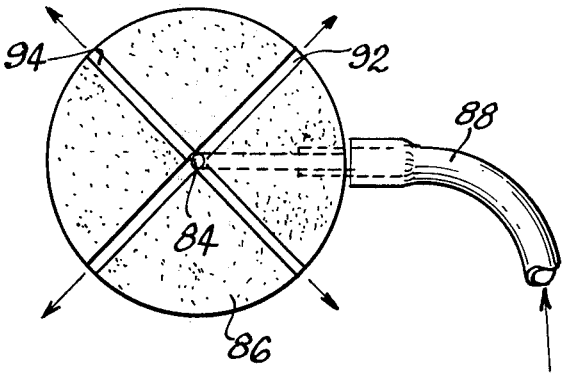
FIG. 17 is still another embodiment of the fixed-super-abrasive tool, viewed from the abrasive side, wherein the abrasive wafer is centrally apertured and radially channeled to permit the circulation of a coolant or lubricant from the center of the grinding surface to the periphery.
Figure 18:
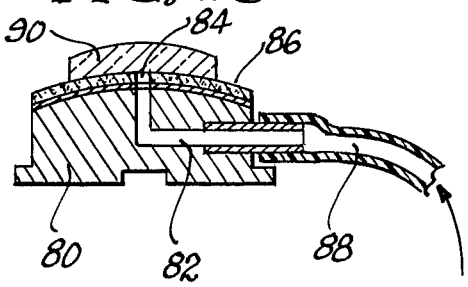
FIG. 18 is a sectional view of the embodiment of FIG. 17 on a slightly reduced scale, and showing the abrasive wafer in contact with a lens blank.

An advantageous embodiment of the present invention is illustrated in FIGS. 17 and 18. Backing member 80 has an internal passageway 82 therein which registers with a centered aperture 84 in abrasive wafer 86. A suitable liquid coolant and lubricant are supplied from a source (not shown) through supply tube 88 to passage 82 and aperture 84 whereby so-called "dead" spots or areas at the interface of abrasive wafer 86 and the workpiece, e.g., lens 90, are eliminated. Preferably, channels 92 and 94 are also provided so that a coolant passageway extends from the center to the outer periphery of the tool. The channels may be restricted or closed so that a pressurized cooling system is created.

This novel approach to the elimination of the so-called "dead" spots may also have application in conventional practice wherein abrasive slurries are used as the grinding medium. The gravity of this problem is well illustrated in the aforementiond patents wherein the various grinding pads are segmented, channeled and otherwise apertured to achieve distribution of the abrasive slurry.

Manifestly, more than one passageway in the backing member and more than one registering aperture in the super-abrasive wafer may be employed. The number and disposition can best be determined empirically depending on the job being performed. The aperture or apertures may be readily molded into the super-abrasive wafer at the time it is hot-pressed to form an integral structure, as illustrated in FIG. 10.

As previously indicated, it is desirable to adjust the size and peripheral shape of a super-abrasive tool to provide the optimum performance in cooperation with the particular lens grinding machine with which it is used. It should be understood that such machines typically mount the super-abrasive tool in a spindle which moves the tool along a predetermined path. The lens, mounted on an opposing spindle is moved in a second predetermined path while being held against the super-abrasive tool. During its movement, the lens sweeps out a geometric shape such as an ellipse, a circle, or even a straight line. The tool is adapted so that its outer edges match but do not exceed the area swept out by the lens during its motion. This adaptation minimizes uneven wear of the tools surface, which can cause poor cooling and swarf removal and shorten the tool's useful life. In this connection it should be remembered that the super-abrasive tools of the invention can replace loose abrasive slurries applied against an easily-worn steel form which have been heretofore used for fine polishing of toric lenses. Such lenses, with their two curvatures, are much more difficult to grind correctly than are spherical lenses having only a single curvature.

As heretofore described, fine polishing of lenses already ground has been carried out heretofore with a loose abrasive slurry applied to a soft pad placed over a steel form of the proper curvature. By adapting certain aspects of the super-abrasive tool, it has been found possible to make a fine polishing tool as a matched set with the super-abrasive tool used for fine grinding. No super-abrasives are used, only a conventional abrasive slurry. A resilient base is made which conforms to the desired toric shape and replaces the steel form and soft pad previously used. In the preferred embodiment soluble particles are introduced into the resilient base material prior to its molding so that a porous surface is continually created as the particles are dissolved away by the fluid which carries the abrasive particles. Improved cooling and swarf removal are also the result of the use of a porous surface for the polishing tool. As before, table salt of 80–120 mesh has been found suitable for creating a porous surface. It is used in amounts up to about 50% by volume of the tool.

From the above description it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

I claim

1. A method of manufacturing a super-abrasive tool for grinding and polishing purposes and having a curvilinear working surface of predetermined desired conformation comprising the steps of:

a. providing a substantially-rigid, non-abrasive backing member having a curved support surface determinative of the curvature of said curvilinear working surface;

b. disposing adjacent said support surface a substantially-malleable, multi-layered, integrally-formed abrasive wafer of predetermined thickness contour having a substantially smooth surface and an abrasive-containing surface, including a thickness in excess of about 1/32 inch, said abrasive wafer comprising i. a layer of super-abrasive particles having uniform surfaces and a Knoop Hardness in excess of about 3000 kg/mm$^2$ and interspersed and bound in a powdered metal matrix having malleability-imparting properties and comprising a major proportion of copper and a minor proportion of tin and ii. a layer comprising a malleable metal having substantially smooth surfaces and substantially free of said super-abrasive particles, said wafer being formed by subjecting said layer of malleable metal and said layer of super-abrasive particles interspersed in a powdered metal binder to sintering conditions of pressure and temperature for the metals to form said multi-layered integrally-formed abrasive wafer;

c. causing the substantially smooth surface of said abrasive wafer to conform to said support surface so as to impart said predetermined desired conformation as to the exposed abrasive-containing surface of said abrasive wafer by interposing said wafer between said support surface and an opposed surface conformable to the predetermined desired conformation and thereafter bringing said support surface and said opposed surface towards one another with sufficient force to accomplish such conformation;

d. releasably securing the conformed wafer of (c) to said backing member.

2. The method of claim 1 wherein said curved support surface has a toric shape which is imparted to said working surface.

3. A method of grinding and polishing toric and other curvilinear lenses comprising the steps of:

a. forming a super-abrasive grinding tool comprising:

i. a substantially-rigid, non-abrasive backing member having a curved support surface determinative of the curvature of said toric and curvilinear lenses and having peripheral dimensions adapted to the motion of the optical grinding apparatus with which it is to be used by determining the area swept out by a lens in motion during the grinding of said lenses and shaping said backing member to match but not to exceed the area swept by said tool during grinding of said lens with the area swept by said lens, ii. a substantially malleable, multi-layered, integrally-formed abrasive wafer of predetermined thickness conformed to the curvature of and releasably secured to said backing member of (i), said abrasive wafer comprising 1. a super-abrasive-containing layer comprising abrasive particles having a Knoop Hardness in excess of about 3000 kg/mm$^2$ and selected from the group consisting of diamonds, cubic boron nitride, and mixtures thereof interspersed and bound in a powdered metal matrix for binding said super-abrasive particles and, 2. a layer substantially free of super-abrasive particles secured to said super-abrasive-containing layer of (1);

said wafer being formed by subjecting said super-abrasive-free layer and said super-abrasive-containing layer to sintering conditions of pressure and temperature for the metals to form said multi-layered abrasive wafer, said wafer being conformed to said backing member by interposing said wafer between said support surface and an opposed surface conformable to the predetermined desired conformation and thereafter bringing said support surface and said opposed surface towards one another with sufficient force to accomplish such conformation;

b. mounting said grinding tool of (a) in an optical grinding machine and employing said tool to grind an optical lens while simultaneously pumping a fluid to cool, lubricate, and flush said lens during said grinding;

c. periodically restoring during its useful life the curvature of said super-abrasive-containing layer of (a) (ii) to the curvature of said backing member of (a) (i) until said super-abrasive-containing layer has been substantially consumed;

d. releasing said wafer having a substantially consumed super-abrasive-containing layer from said backing member and thereafter securing a replacement wafer to said backing member and e. representing steps (b), (c), and (d).

* * * * *